US006390588B1

(12) United States Patent
Ikeda

(10) Patent No.: US 6,390,588 B1
(45) Date of Patent: May 21, 2002

(54) PRINTING APPARATUS AND METHOD OF DETECTING REGISTRATION DEVIATION

(75) Inventor: Keiichi Ikeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/356,696

(22) Filed: Jul. 20, 1999

(30) Foreign Application Priority Data

Jul. 21, 1998 (JP) ..... 10-205593
Jul. 14, 1999 (JP) ..... 11-200996

(51) Int. Cl.[7] ..... B41J 2/01
(52) U.S. Cl. ..... 347/19; 347/37
(58) Field of Search ..... 347/14, 19, 37, 347/43; 400/279, 283

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,289,208 A | * | 2/1994 | Haselby | 347/19 |
| 5,600,350 A | * | 2/1997 | Cobbs et al. | 347/19 |
| 5,936,645 A | * | 8/1999 | Niikura et al. | 347/14 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Craig A. Hallacher
(74) *Attorney, Agent, or Firm*—Fitzpatrick, Cella, Harper & Scinto

(57) ABSTRACT

According to the position information, based on the encoder signal, about the print heads during movement which is obtained in connection with the print start timing of the signal used by the print heads to print the registration adjust patterns, the amount of registration deviation between the print heads are determined. Then, the differences between the print start time of the signal and the leading and trailing edge of the encoder signal are determined for each print head. The difference between these differences is adjusted as the deviation amount between the heads to adjust the ejection timing of each head. This can correct the print position deviations between the plurality of the heads with high precision without being influenced by variations in the head movement speed.

12 Claims, 17 Drawing Sheets

PRINTING APPARATUS AND METHOD OF DETECTING REGISTRATION DEVIATION

This application is based on Japanese Patent Application No. 10-205593 (1998) filed Jul. 21, 1998 and Japanese Patent Application No. 11-200996 (1999) filed Jul. 14, 1999, the contents of which are incorporated hereinto by reference.

BACKGROUND OF THE INVENTION

1. Field of the Invention

The present invention relates to a printing apparatus having a plurality of print heads to print on a printing material, and more specifically to a printing apparatus that controls print timing among the plurality of the print heads to adjust printing positions by the plurality of printing heads.

2. Description of the Prior Art

One of the known printing apparatus is a color printer of an ink jet type and its main construction is shown in FIG. 1.

When performing printing to a paper 105 on a platen 106, at first, a motor 103 is driven and its driving force is transmitted through a drive belt 109 to a carriage 102 which in turn is moved to where a home position sensor 108 is located. Next, the carriage 102 is moved in a direction of arrow A in the figure to scan over the printing paper. During this scan, color inks of black K, cyan C, magenta M and yellow Y are ejected from print heads 120, 121, 122, 123, respectively, at predetermined timings to print an image. After a predetermined length of the image has been printed, the carriage 102 is stopped and then moved in a direction of arrow B opposite the arrow A and returned to the position of the home position sensor 108. During this return pass, the paper is fed by a distance equal to the width of an array or strip of printed dots of inks printed by the print heads 120–123. That is, paper feed rollers 100, 101 are driven by a paper feed motor 107 to advance the paper in a direction of arrow C in the figure. With the above-described operation repeated, the printing of a color image proceeds. Reference numeral 111 represents a paper-detecting sensor.

When the color printing is performed by using the construction described above, ink droplets of black K, cyan C, magenta M and yellow Y ejected from the print heads 120–123 need to be landed on the paper at each pixel in a predetermined overlapping or an adjacent positional relationship. When, however, the mounting positions of the print heads on the carriage 102 are shifted due to a replacement of the print head or the like, the ejected ink droplets may fail to be landed in the predetermined overlapping or the adjacent positional relationship, deteriorating the print quality. One known method for solving this problem involves printing chart patterns 130–133 for registration deviation detection as shown in FIG. 2 before actual printing and adjusting the printing positions of each head based on the patterns. More specifically, reading the chart patterns is performed by means of a sensor or the like and time differences between detecting respective charts in a signal 134 output from the sensor is measured, so that registration deviations among the print heads are detected. Then, based on the detected deviations, the ejection timings of the respective heads are adjusted. Thereby, the respective color dots are controlled to overlap each other at same positions, for example. In more detail, the reading sensor is mounted on the carriage and is made to scan and read the chart patterns 130–133 so that the respective times T1–T4 are measured as time from a leading edge to a trailing edge of the signal 134 output from the sensor. Then, a median value of each time is calculated to determine differential times t1–t3 between the median values of the adjacent patterns. Further, based on comparison between respective values in the case that the respective heads are in respective proper positions and the measured differential value t1–t3 obtained as described above, positional deviation values are calculated. These calculated values are used for adjusting the ejection timings of the print heads 120–123 so that the actual ink landed positions can be in accord with each other.

In the above prior art example the carriage traveling times are measured and, based on this measurement, the positional deviations among the heads are calculated in the form of time. In this case, if a motor for driving the carriage is that can be controlled at a constant driving speed as with a stepping motor, the positional deviation may be measured to some precision. However, when the constant speed control is relatively difficult, as with a DC motor, variations in the carriage speed will affect the measurement in time of the positional deviations, making the precise measurement of positional deviations impossible. In other words, because of the speed variations, it is not guaranteed that, for the same time period, a distance traveled by the carriage during the measurement of the deviations is equal to the travel distance during the actual printing operation. This means there is an essential problem that the adjustment based on the measured deviations is not reflected on the actual printing.

Further, in another conventional example, it is also possible that the positional deviation is measured based on signals from an encoder that detects the carriage position while traveling and outputs signals as references for the ejection timings of individual heads, instead of based on the travel times of the carriage as in the above case, and the measurement of the positional deviations free from influences of variations in the carriage speed can be realized. With this method, however, because the output signal from the encoder is normally output at intervals corresponding to the intervals of ejection timings of the print heads, there is a drawback that the positional deviations can only be measured with a relatively rough precision with dot intervals as the minimum unit.

SUMMARY OF THE INVENTION

An object of the present invention is to provide a printing apparatus capable of correcting printing position deviations among a plurality of heads with high precision while minimizing the influence of variations in the head travel speed.

In the first aspect of the present invention, there is provided a printing apparatus for performing printing on a printing medium by using a plurality of print heads, comprising:

scanning means for causing a plurality of print heads to scan over the printing medium relatively to each other;

print position detection means for detecting a print position of each print head with respect to the printing medium during scanning by the scanning means and for outputting a position detection signal representing the print position thus detected;

pattern printing means for causing the plurality of print heads to print respective registration adjustment patterns during scanning by the scanning means;

pattern detection means for reading the registration adjustment patterns during scanning in the relative scanning direction to output signals representing the print positions of the plurality of the print heads; and registration adjustment means for determining, for each of the plurality of the print heads, a time difference between a first predetermined timing in pattern printing obtained from the signal output by the pattern detection means and a second predetermined timing obtained, in connection with the first predetermined timing, from the position detection signal output by the print position detection means, the time difference being smaller than a period of the position detection signal, and for correcting respective print timings of the plurality of the print heads according to the time difference between the plurality of the print heads.

In the second aspect of the present invention, there is provided a registration deviation detection method in a printing apparatus using a plurality of print heads to perform printing on a printing medium, comprising the steps of:

preparing print position detection means for detecting a print position of each print head with respect to the printing medium during scanning of the print heads and for outputting a position detection signal representing the print position thus detected, and pattern detection means for reading registration adjustment patterns during scanning in a relative scanning direction to output signals representing the print positions of the plurality of the print heads;

printing the registration adjustment patterns by using the plurality of the print heads while the plurality of the print heads are scanned; and determining, for each of the plurality of the print heads, a time difference between a first predetermined timing in pattern printing obtained from the signal output by the pattern detection means and a second predetermined timing obtained, in connection with the first predetermined timing, from the position detection signal output by the print position detection means, the time difference being smaller than a period of the position detection signal, and for correcting respective print timings of the plurality of the print heads according to the time difference between the plurality of the print heads.

According to above-stated structure, based on a result of reading the registration adjustment patterns, time differences are calculated between print start timing obtained from these patterns and the leading or trailing edge timing of the output signal for each head, which is detected in connection with the print start timing, from the print position detection means, such as an encoder, that outputs a signal representing stationary coordinates with respect to the apparatus. A difference between these time differences, which are determined for individual print heads, is taken as the print timing deviation of the print heads with respect to each other and then corrected. Thereby, even when there are variations in the print head scanning speed, the effect of these speed variations on the measurement of the print timing deviations can be limited to a small fraction of time (i.e., the time difference described above) which is measured with timing of the leading edge in the output signal from the print position detection means taken as a reference. This in turn reduces the amount of speed variations appearing in the deviation amount being measured. In this case, because the signal output from the print position detection means represents stationary coordinates with respect to the apparatus which are not affected by the speed variations, it is possible to make the reference used for the measurement of the deviation free from influences of the carriage speed variations. Further, the time difference is smaller than a pitch of the print positions corresponding to periods or cycles of the output signal from the print position detection means and therefore it is possible to perform finer corrections.

The above and other objects, effects, features and advantages of the present invention will become more apparent from the following description of embodiments thereof taken in conjunction with the accompanying drawings.

DESCRIPTION OF THE PREFERRED EMBODIMENTS

Now, embodiments of the present invention will be described in detail by referring to the accompanying drawings.

(First Embodiment)

Figure 3:
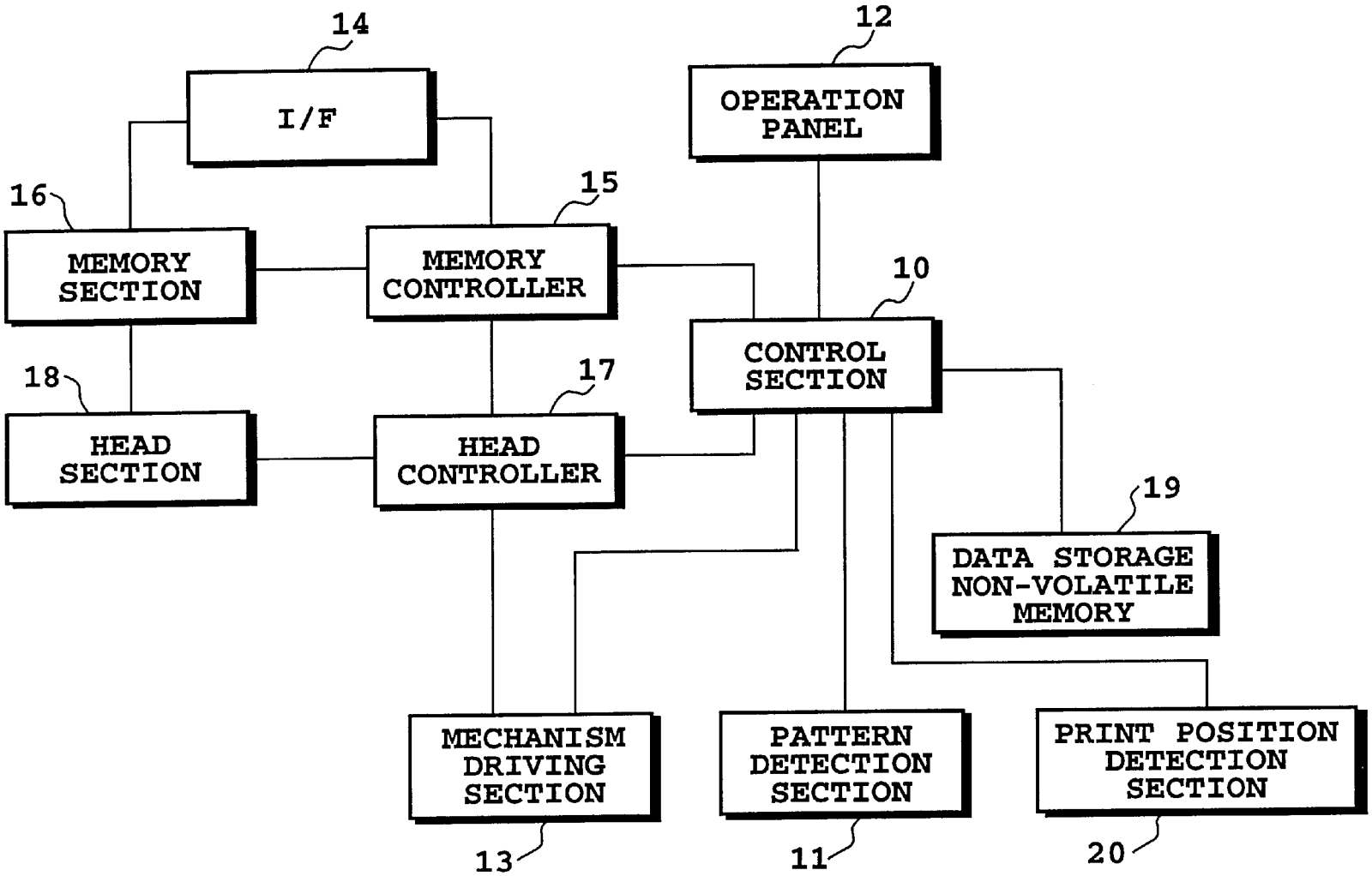
FIG. 3 is a block diagram showing mainly a control configuration of an ink jet printing apparatus according to one embodiment of the invention.

FIG. 3 is a block diagram showing mainly the control configuration of an ink jet printing apparatus according to the first embodiment of the invention.

In FIG. 3, reference number 10 denotes a control section that performs an overall control on the printing apparatus. Reference numeral 11 denotes a pattern detection section mounted on a carriage in a mechanism driving section 13 (not shown) to identify registration deviation detection patterns printed on a printing paper. In order to be able to distinguish between black K, cyan C, magenta M and yellow Y inks ejected from the print heads, the pattern detection section 11 comprises a light source, which radiates light of complementary colors by selecting from among red R, green G and blue B filters, and a sensor to receive light which is emitted from the light source and reflected by the printing paper. The output of the light receiving sensor is amplified by a amplifier circuit not shown and then compared with a reference signal by a comparator and converted into a digital signal of 0 V or 5 V. The digitized signal and an inverted signal of the digital signal produced by an inverter circuit are fed to interrupt terminals of an MPU (microprocessor unit) in the control section 10. The control section 10 can then detect in real time the leading and trailing edges of the sensor output signal from the pattern detection section 11. Reference number 20 represents a print position detection section 20 which has a linear scale extending over a range of movement of the carriage mounting print head and which outputs a print position detection signal (hereinafter also referred to as an encoder signal) corresponding to slits formed at predetermined intervals in the linear scale. The print position detection section 20 may use a known configuration, whose detailed explanation is omitted here. As can be seen from the construction of the linear scale, the encoder signal is the one that represents stationary position coordinates in the apparatus.

The mechanism driving section 13 has a construction almost similar to the one described above in connection with FIG. 1. That is, it includes the carriage for moving the print heads in the main scan direction, the carriage driving section, a printing paper feed section, a paper transport section, a paper discharge section, and an ejection recovering unit for eliminating ink clogging and recovering the ink ejection performance of the print heads. The mechanism driving section 13 further includes the above-described linear encoder, which forms the print position detection section 20, and a sensor unit mounted on the carriage for optically detecting the slits of the linear encoder.

Designated 12 is an operation panel consisting of switches for paper feed, discharge and selection and a display for indicating the status of the ink jet printing apparatus. The control section 10 performs monitoring of the switches and the status indication. Denoted 14 is an interface section which is connected to a host computer not shown. The host computer sends commands and print data, according to which the ink jet printing apparatus operates to print the print data. Generally, the interface section 14 uses Centronics and SCSI interface. A memory controller 15 transfers commands entered from the interface section 14 to the control section 10, and generates an address and a write timing signal for wiring the print data into a memory section 16 under the control of the control section 10. The command entered from the interface section 14 is interpreted by the control section 10, which in turn controls the entire ink jet printing apparatus.

The memory section 16 has at least one band of memory required for the print heads to perform one-time scanning and printing in the main scan direction. For example, if the print heads each have 128 nozzles and the maximum number of dots printed by a single scan of each head in the main scan direction is 8 k dots, then the memory section 16 has a memory capacity of:

128 (nozzles)×8 k(dots)×4 (colors)=4M bits. A memory controller 15 and the memory section 16 are so arranged that special pattern data for the registration deviation detection pattern can be generated in the memory section 16, as required, by the control section 10. In this case, there is no need to transfer data from the host computer.

A head controller 17 controls a head section 18 according to the control of the control section 10. The actual arrangement of the head section 18 comprises print heads of various colors mounted on the carriage in the mechanism driving section 13. Designated 19 is a data storage non-volatile memory which stores correction data generated after the registration deviation detection performed at the time of head replacement.

Next, by referring to flowcharts of FIGS. 4 to 7, a detection of registration deviation of each head will be explained.

Figure 4:
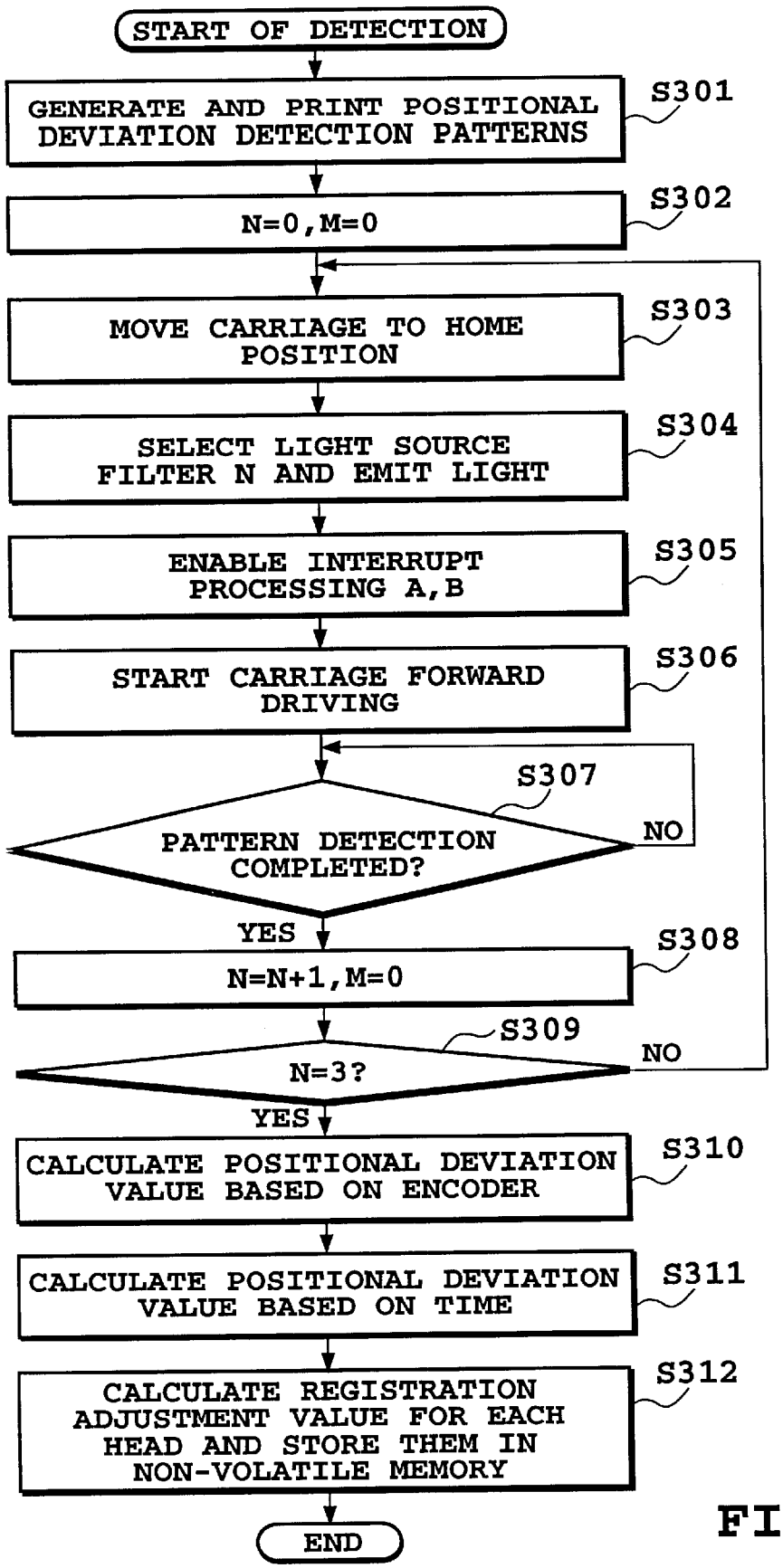
FIG. 4 is a flowchart showing a procedure for adjusting registration among a plurality of print heads according to the first embodiment of the invention.

In the ink jet printing apparatus of the present embodiment, when a head in the head section 18 is detected to have been replaced, the registration deviation detection operation shown in FIG. 4 initiated. First, the control section 10 controls the memory controller 15 to generate the registration deviation detection patterns indicated by reference numerals 500–503 in FIG. 8 in the memory section 16 and prints the patterns (S301). Then, counters N, M indicating the number of registration detection are cleared (S302) and the mechanism driving section 13 is driven to move the carriage to the home position (a standby position before starting the printing) (S303). Further, according to the registration detection counter N, a filter of the pattern detection section 11 is selected as follows and a light emitting element (S304) is activated.

N=0: red, 1: green, 2: blue

The filter selection is done in order to amplify sensitivity of the light receiving section by emitting a complementary color of an ink color to be read when the light receiving section of the pattern detection section 11 reads the printed registration deviation detection patterns. That is, when N is 0, a cyan component which is a complementary color for red is read; when N is 1, a magenta component which is a complementary color for green is read; and when N is 2, a yellow component which is a complementary color for blue is read. As for a black ink, because it includes cyan, magenta and yellow components equally, any filter may be used to receive light.

Figure 8:
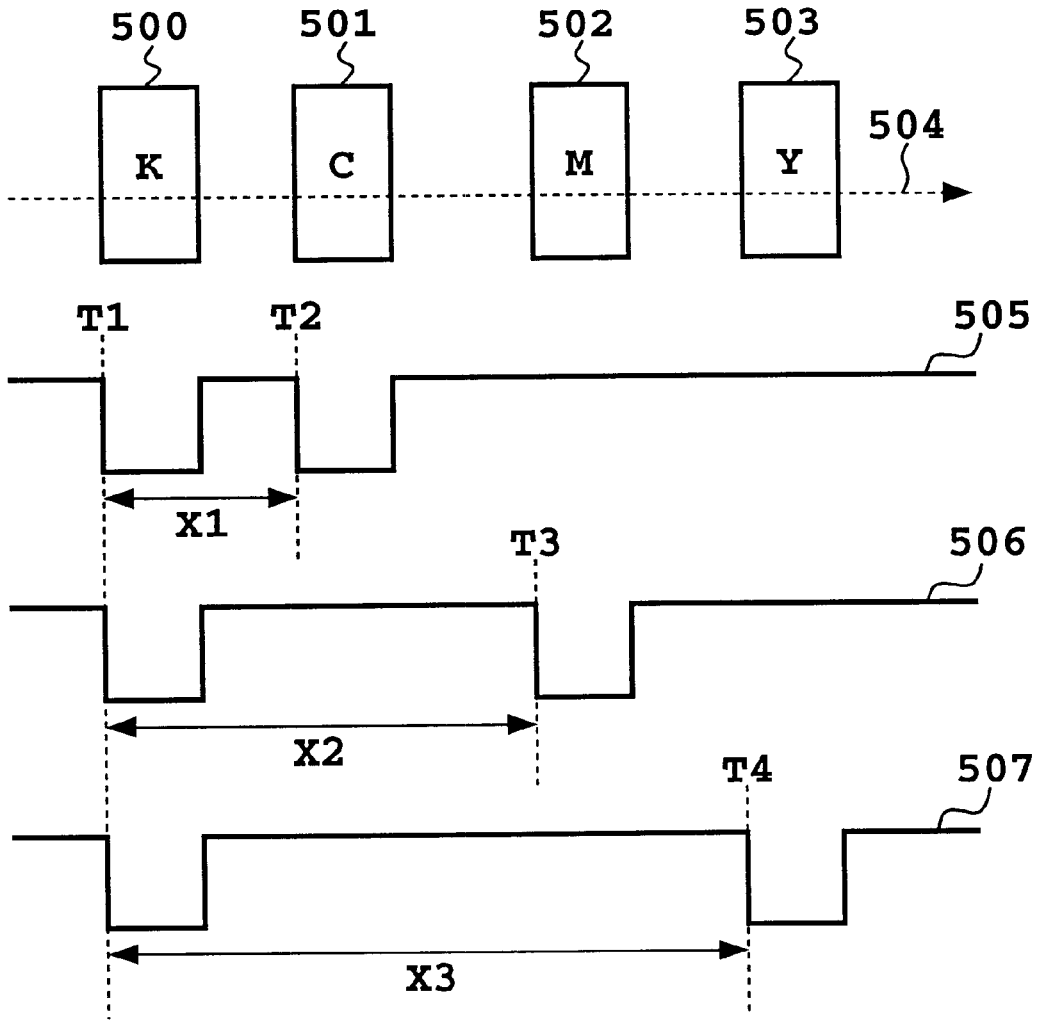
FIG. 8 is a diagram showing adjust patterns printed by print heads and pattern detection timings based on positions indicated by the encoder.

Next, interrupts A, B for the MPU (microprocessor) in the control section 10 that are produced in synchronism with the trailing and leading edges of the sensor signal from the pattern detection section 11 are enabled (S305) and the mechanism driving section 13 is driven to move the carriage in the forward direction indicated by a dashed lined 504 in FIG. 8. Detection processing of registration deviation detection patterns following these processing is carried out at an interrupt processing described later, and the main processing becomes stand by state until the pattern detection processing in the interrupt processing is completed. (S307).

Figure 5:
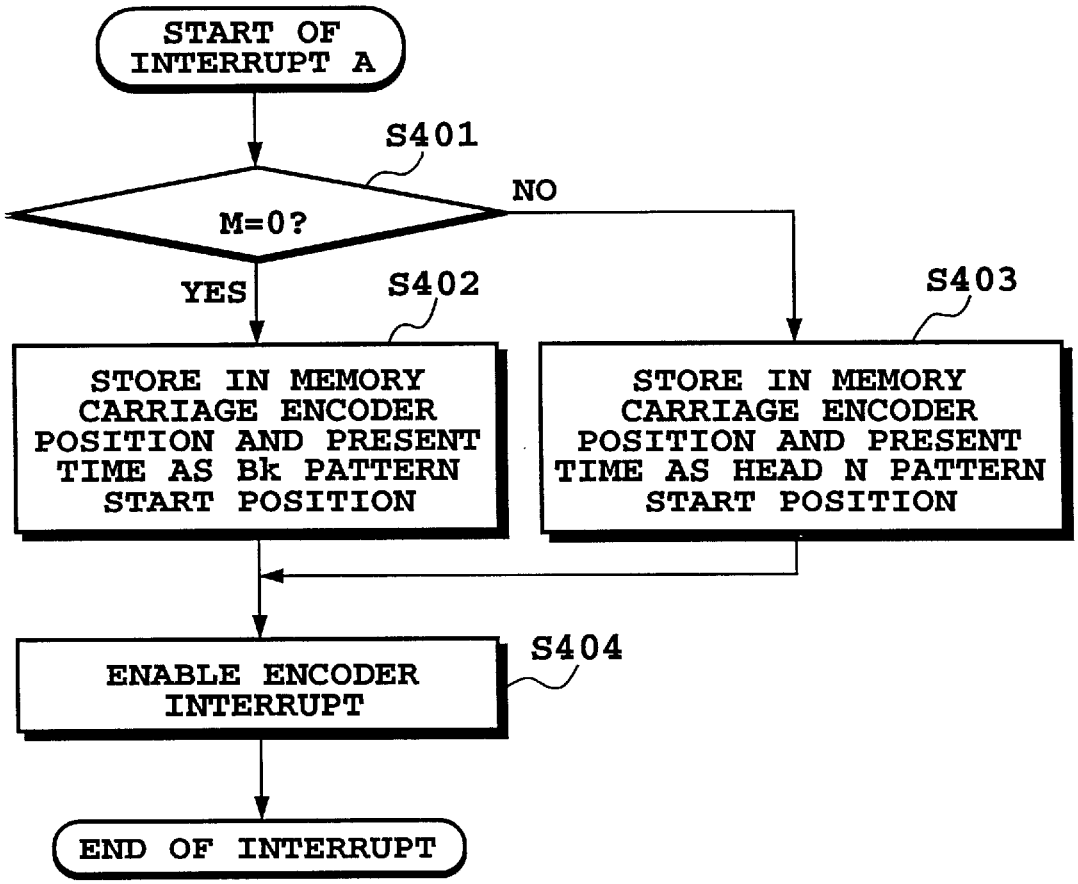
FIG. 5 is a flowchart showing an interrupt procedure for detecting an encoder position and other information, performed during the registration adjustment processing.

More specifically, in the control section 10, the interrupts is generated in synchronism with the leading and trailing edges of the sensor signals 505, 506, 507 from the pattern detection section 11 of FIG. 8. At the trailing edge interrupt A shown in FIG. 5 is generated.

In this interrupt A processing, when the registration detection counter M is 0, an encoder value representing the present position of the carriage and a time value T1 are stored as a black pattern start position, based on the encoder signal output from the print position detection. section 20 (S401, S402). When M is 1, the encoder value and the time value Tn are stored as a pattern start position of an ink color corresponding to the registration detection counter N (0: cyan, 1: magenta, 2: yellow) (S401, S403). Here, a unit of the time value is set to be on an order of several Rsec depending upon the carriage moving speed. Then, an encoder interrupt described later which is generated in synchronism with the leading and trailing edges of the encoder signal is enabled (S404) and processing exits from the interrupt processing shown in FIG. 4.

Figure 6:
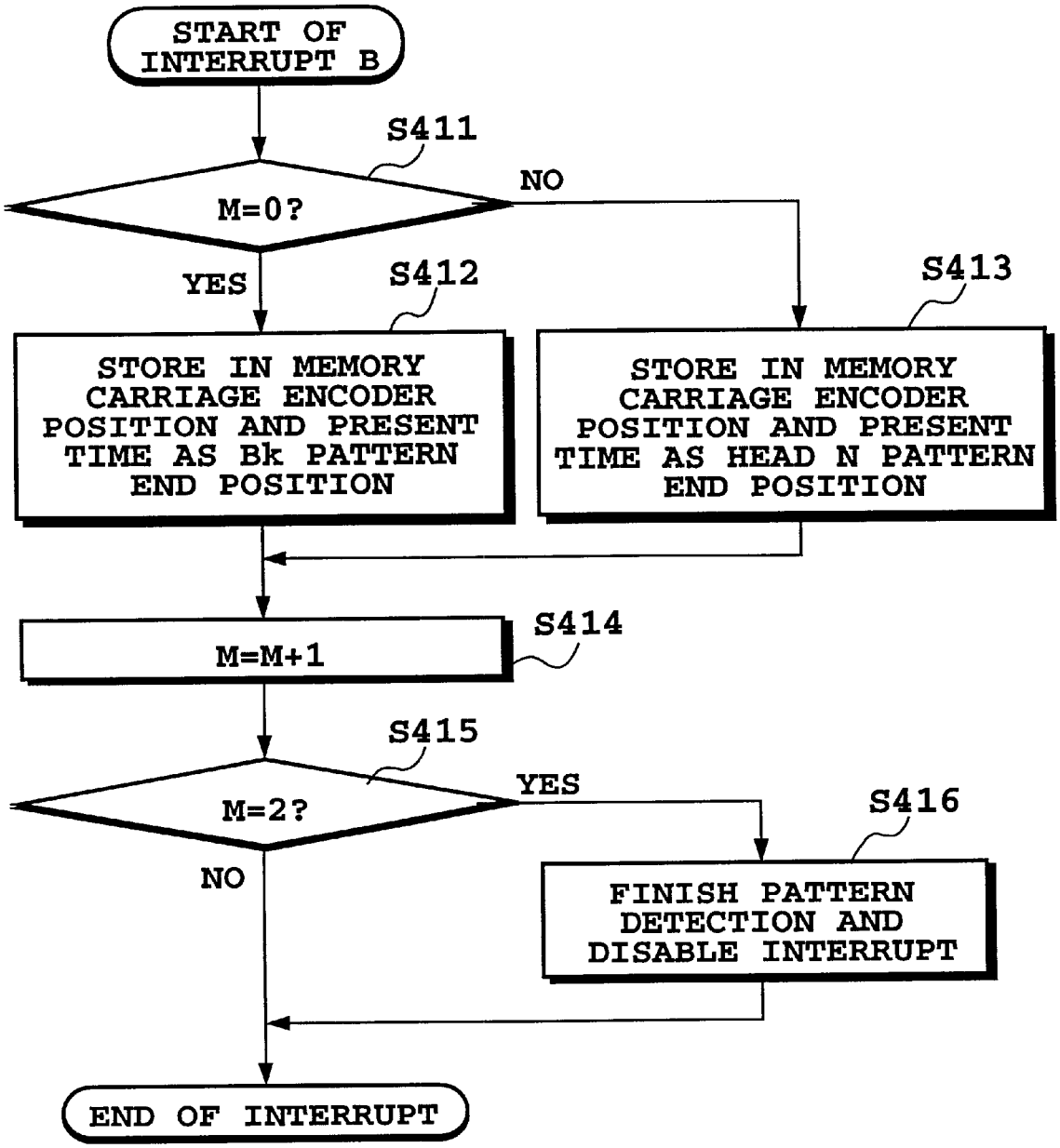
FIG. 6 is a flowchart showing an interrupt procedure for detecting an encoder position and other information, performed during the registration adjustment processing.

On the other hand, interrupt B shown in FIG. 6 is initiated at the leading edge. In the interrupt B processing, when the registration detection counter M is 0, the encoder value representing the present position of the carriage and a time value T1 are stored as a black pattern end position, based on the encoder signal output from the print position detection section 20 (S411, S412). When M is 1, the encoder value and the time value Tn are stored as a pattern end position of an ink color corresponding to the registration detection counter N (S411, S413). Then, the value of the registration detection counter M is incremented by 1 (S414). When this M value is 2, it is decided that the pattern detection has been completed and the interrupts A, B for registration deviation detection are disabled, processing exits from the interrupt processing shown in FIG. 6.

Referring again to FIG. 4, when it is decided that the pattern detection by the interrupt processing A, B have been finished (S307), the value of the registration detection counter N is incremented by 1 and the registration detection counter M is cleared. Then, if the registration detection counter N is not 3, it is decided that the registration deviation detection is not completed for the heads of all colors (S309) and the preceding steps S303–S309 are repeated.

Figure 7:
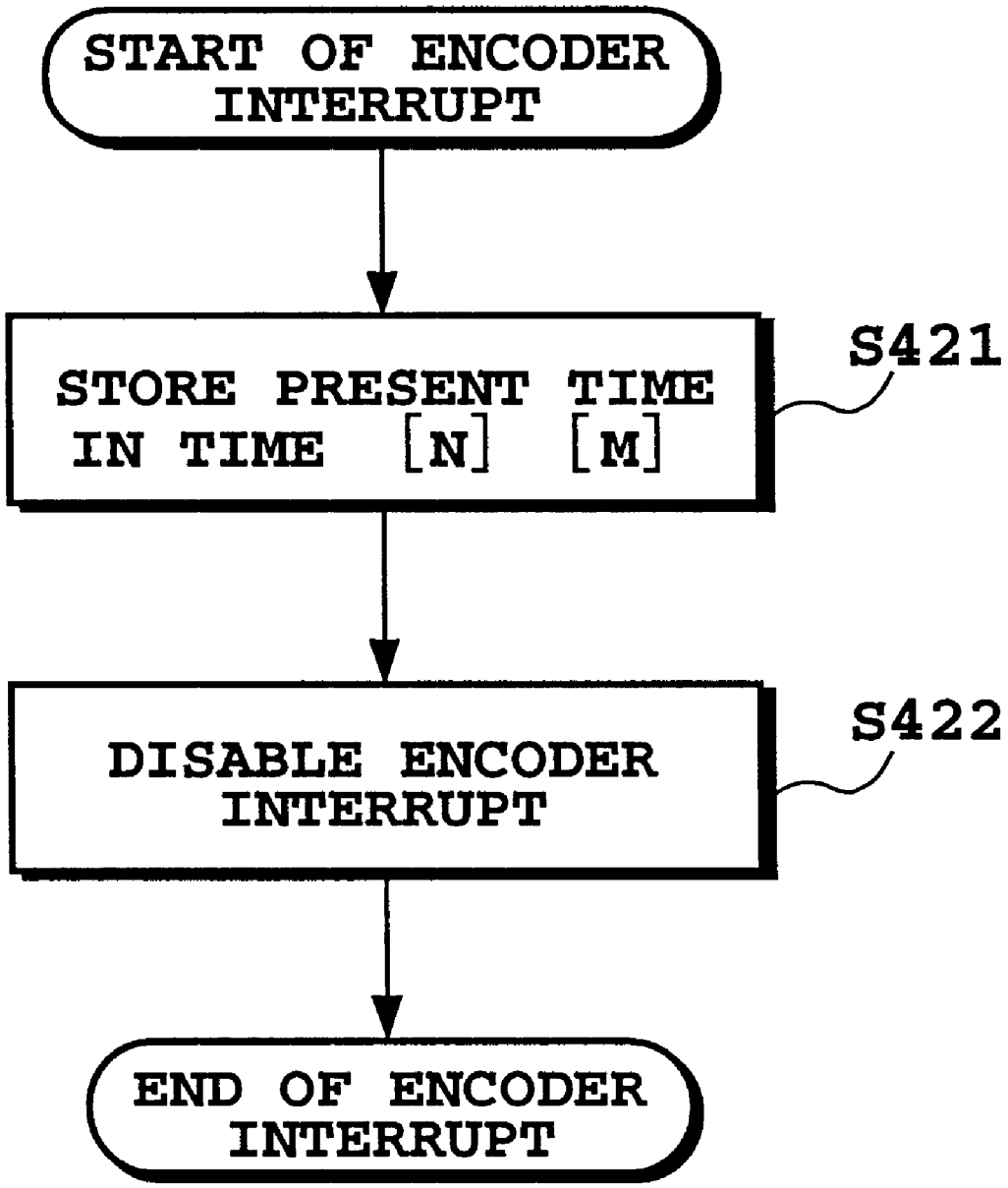
FIG. 7 is a flowchart showing an interrupt procedure based on an encoder signal, performed during the registration adjustment processing.

In the above processing, as the carriage moves, the encoder signal is generated by the print position detection section 20. The encoder interrupt processing enabled by the interrupt A processing shown in FIG. 5 stores the time of a leading or trailing edge of the encoder signal that occurs immediately after the interrupt is enabled into a memory location of Time [N] [0], as shown in FIG. 7. Then the next encoder interrupt stores the time of the leading or trailing edge of the encoder signal into Time [N] [1] on the memory (S421–S422).

When at step S309 shown in FIG. 4 it is decided that the registration detection counter N is 3, the registration deviation pattern detection for the four color heads have been completed. At this time, since the position information about the sensor outputs 505, 506, 507 shown in FIG. 8 has been obtained, the amount of registration deviation is calculated based on the encoder value (S310). This calculation uses the encoder values obtained by the interrupt A or B that is enabled by the leading or trailing edge of the sensor signals 505–507 output from the pattern detection section 11 to determine differences of the encoder value between the black pattern and respective color patterns (x1, x2, x3 shown in FIG. 8). While the example shown in FIG. 8 uses the encoder values between the leading edges of the sensor signals 505, 506, 507, either of the leading and trailing edges of the sensor signals may be used, whichever has a better characteristic.

The data x1, x2, x3 thus determined are position data representing the respective print positions of the cyan, magenta and yellow heads with the black head taken as a reference. Here, proper encoder distances between the patterns, which distances are previously known in accordance with mechanically determined mounting positions of the heads in relation to each other, are designated by X1, X2, X3, then the actual positional deviations of individual heads are given by $$x1'=x1-X1,\ x2'=x2-X2,\ x3'=x3-X3$$

According to these positional deviations, the ink ejection timing of each head can be shifted to make registration deviation adjustments. In practice, because these positional deviations are based on the encoder output, they are represented in units of dots. Therefore, the adjustment of ejection timing can be realized by adjusting and shifting the address of the print data read out from the band memory corresponding to each color head.

The amount of deviation calculated from the encoder value, however, can only be measured with a resolution of a dot pitch (slit intervals on the linear scale) and thus the adjustment of the registration deviation has a possibility of including an error of ±1 dot pitch. Therefore, in order to calculate the positional deviation to a precision of less than ±1 dot, the amount of positional deviation is determined in terms of time (S311).

This calculation, as in the calculation of the deviation based on the encoder, uses only the time values determined by the interrupt processing A, B which are enabled at the leading or trailing edges of the sensor signals 505–507 from the pattern detection section 11 and calculates time differences of less than ±1 dot between the black pattern and the respective color patterns for each measuring signal 505–507. For example, when the points in time of the trailing edges of the sensor signals from the pattern detection section 11 corresponding to the black, cyan, magenta and yellow patterns are T1, T2, T3 and T4, the registration deviations of less than ±1 dot between the black head and the respective color heads are expressed as follows.

$$\Delta TBk_C=(\mathrm{Time}[0][0]-T1)-(\mathrm{Time}[0][1]-T2)$$

$$\Delta TBk_M=(\mathrm{Time}[1][0]-T1)-(\mathrm{Time}[1][1]-T3)$$

$$\Delta TBk_Y=(\mathrm{Time}[2][0]-T1)-(\mathrm{Time}[2][1]-T4)$$

Figure 9:
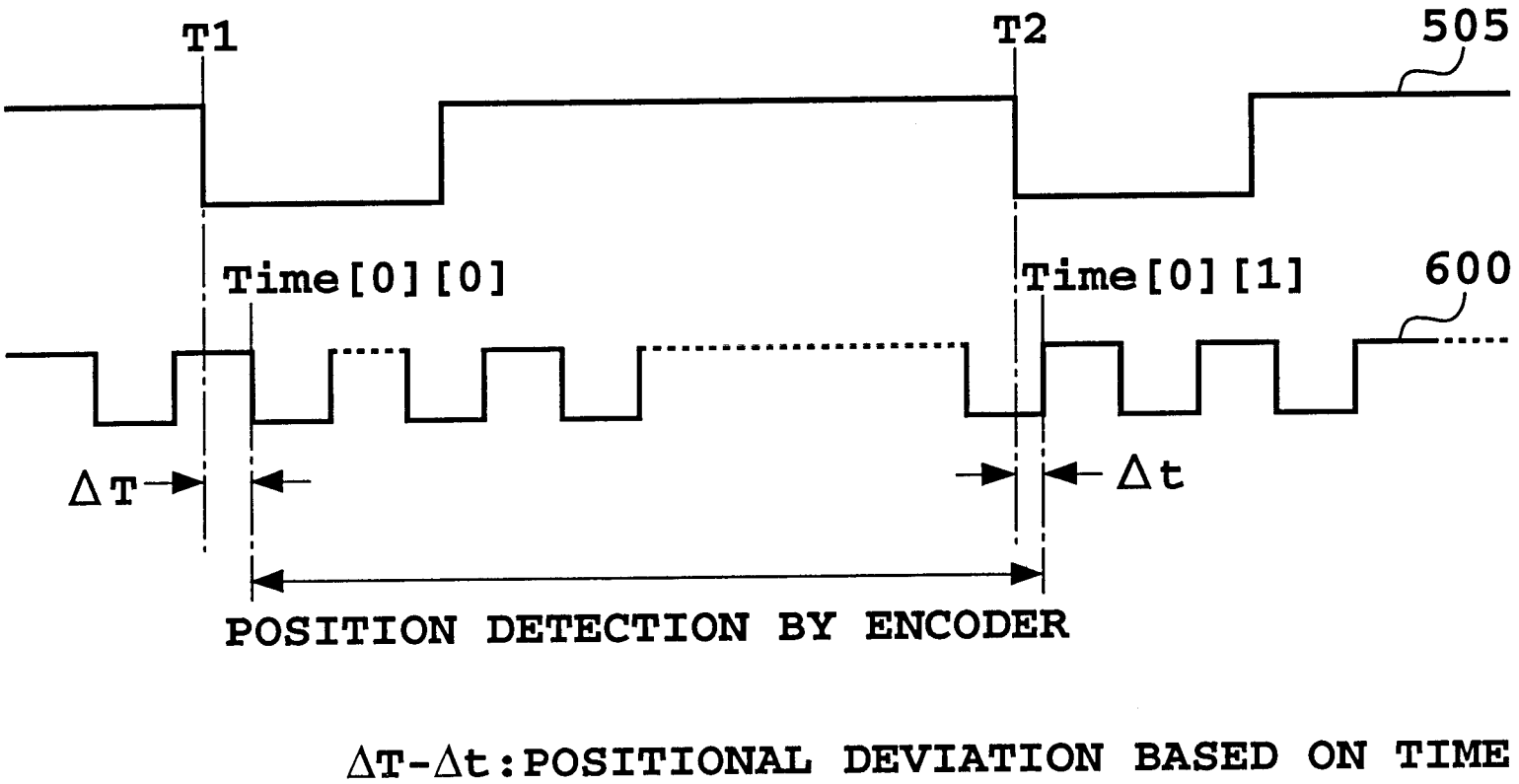
FIG. 9 is a diagram showing how positional deviations are calculated according to the detection described above with the encoder signal time taken as a unit.

FIG. 9 explains the detection, according to the above equations, of an amount of positional deviation of black and cyan heads in the case of the sensor output signal 505.

In the figure, reference number 600 indicates a signal from the print position detection section 20 representing the carriage position, and the expression ΔTBk_C is represented by ΔT−Δt in the figure. That is, ΔT represents an ejection timing deviation of the black head from the encoder signal and Δt represents an ejection timing deviation of the cyan head with respect to the encoder signal. Thus, ΔT−Δt represents a positional deviation of ejection timing of less than ±1 dot between the head that ejects black ink the head that ejects cyan ink. When this value is positive, the ejection timing of the cyan head is advanced with respect to the ejection timing of the black head by ΔT−Δt to correct the position deviation so that the inks ejected from both heads will be landed on the paper correctly overlapping each other or in a correct adjacent positional relationship. On the other hand, when ΔT−Δt is negative, the ejection timing of the cyan head is delayed by ΔT−Δt.

Referring again to FIG. 4, the ejection timing of each head can be shifted in time according to the registration deviation amount of less than ±1 dot thus obtained to adjust the registration deviation. Further, the registration adjustment data for each head is stored in the data storage non-volatile memory 19 (S312). After this, when power is turned on, the registration adjustment data is read by the control section 10 that in turn corrects the head drive timing during printing.

While this embodiment explains the method of measuring the amount of registration deviation between the heads in the direction of carriage feed, the positional deviation in the direction of paper feed can also be measured in the similar manner. Although an example has been shown which uses only one phase of the encoder output, it is needless to say that the similar positional deviation detection can be performed when encoder outputs made up of phases A and B are used, which enable measurements with four times the resolution of the previous case.

(Second Embodiment)

Figure 10:
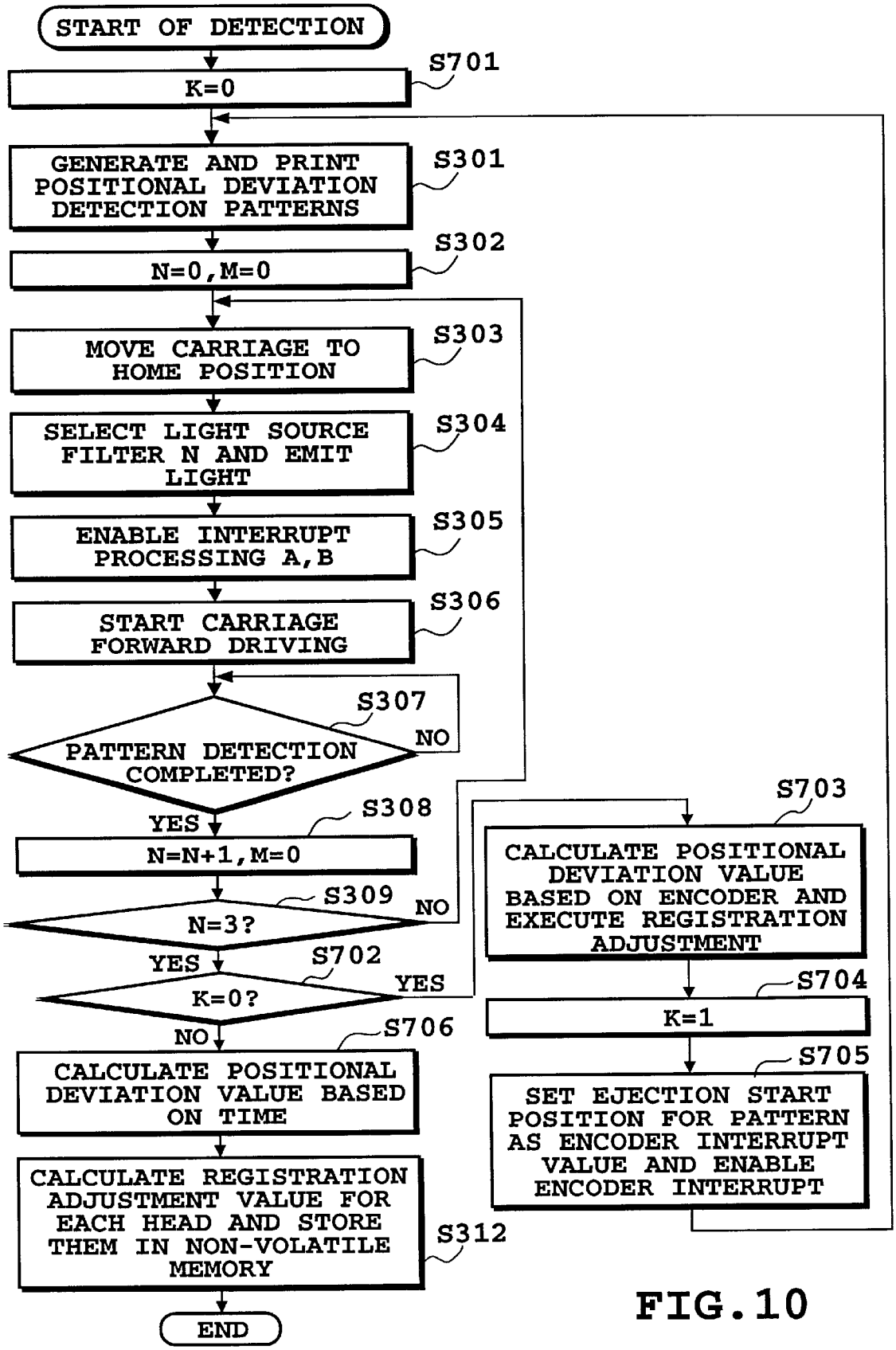
FIG. 10 is a flowchart showing a procedure for adjusting registration among a plurality of print heads according to a second embodiment of the invention.

The second embodiment of the invention slightly differs from the first embodiment in the method of detecting the positional deviation. FIG. 10 is a flowchart showing the procedure for detecting the amount of positional deviation in the second embodiment. Steps similar to those of FIG. 4 used in the first embodiment are assigned the identical reference numbers.

When this processing is started, a variable K is initialized to 0 (S701) and the registration deviation detection patterns are generated and printed as in the first embodiment (S300, S301). Then, the positional deviation detection is performed as in the first embodiment (S302–S309). Points in which these processing differ from the first embodiment are interrupt processing A, B, which are arranged to select either the encoder value or the time value for storage in memory depending on the value of the variable K. When K is 0, the encoder value is stored; and when K is 1, the time value is stored.

When the step S309 decides that N has reached 3, this means that the detection of all the color patterns is finished. So, step S702 checks the value of K. When K is 0, step S703 performs the positional deviation detection based on the encoder as in the first embodiment. According to the amount of registration deviation thus obtained, the timing of reading the print data from the memory is changed as described above to perform the registration deviation adjustment.

Then, the variable K is changed (S704) and the print start encoder position of each color head is set in the encoder counter not shown as the encoder interrupt value (S705). The encoder counter compares the set value and the actual encoder value by a comparator and, when they agree, sends an interrupt signal 802 shown in FIG. 11 to the MPU (microprocessor) in the control section 10. The encoder interrupt processing is similar to the one performed in the first embodiment that stores in the memory the point in time at which an interrupt is produced. This processing stores in the memory the point in time of the black head print start timing and the point in time of each color head print start timing.

After this, processing of steps S301 to S309 are performed again to measure the positional deviations. At this time, because the value of K is 1, the point in time at which the interrupt was produced is stored during the interrupt processing A, B. Then, when step S309 decides that N is 3, the measurement of the positional deviations in terms of time for all heads is terminated. Because step 702 decides that K is 1, step S706 performs calculation of the positional deviations in terms of time.

Figure 11:
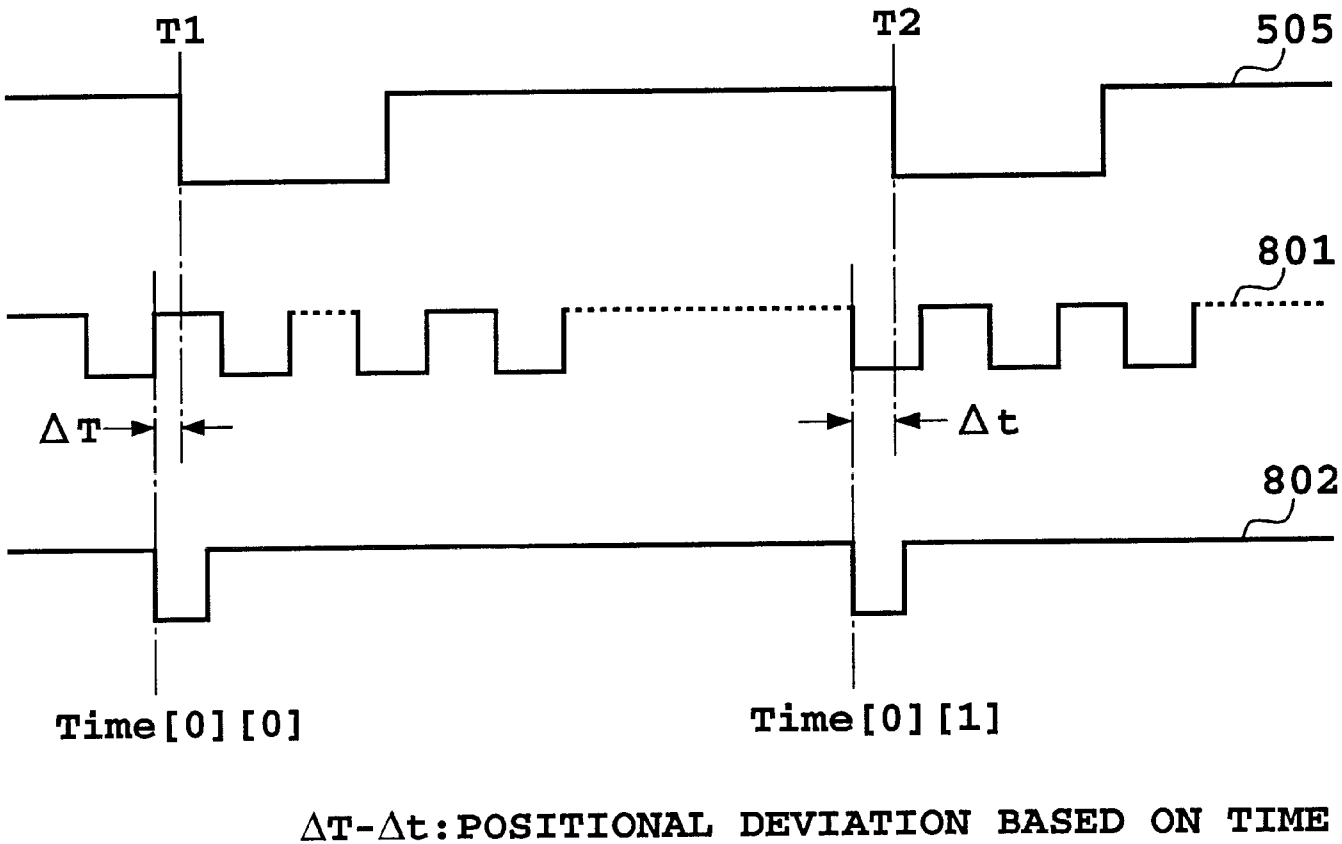
FIG. 11 is a diagram showing how positional deviations are calculated with the encoder signal time taken as a unit during the registration adjustment of the second embodiment.

FIG. 11 shows an example of the sensor signal 505 produced for the detection of the positional deviation between the black head and the cyan head. In the figure, denoted 801 is a signal from the print position detection section 20 representing the carriage position. Designated 802 is an interrupt signal produced by the encoder counter after step 703 has executed the registration deviation adjustment based on the encoder value. This interrupt signal is generated in synchronism with the leading edge or trailing edge of the encoder signal that is produced when each of the registration deviation detection patterns begins to be printed. This interrupt signal causes an interrupt to the MPU (microprocessor unit) in the control section 10 and the point in time at which the interrupt has occurred is stored in memory. The difference between this interrupt time and the time measured by the interrupt A or B is calculated as $\Delta T$ for the black head and as $\Delta t$ for the cyan head. Then a difference between these differences, $\Delta T-\Delta t$, represents a registration deviation amount of less than 1 dot pitch between the black ink ejection head and the cyan ink ejection head. When this difference value is negative, the ejection timing of the cyan head is advanced by $\Delta T-\Delta t$ with respect to the ejection timing of the black head to perform registration deviation adjustment in order to ensure that the inks ejected from these two heads are landed on the paper correctly overlapping each other or in a correct adjacent positional relationship. When it is positive, the ejection timing of the cyan head needs to be delayed by $\Delta T-\Delta t$. According to each registration deviation amount of less than ±1 dot obtained in this way, the ejection timing of each head can be shifted in time to perform the registration deviation adjustment.

In the second embodiment described above, the number of times that the measurement is made by operating the carriage is two times that of the first embodiment. But a more efficient registration adjustment is realized by first measuring the registration deviation amount based on the encoder value and performing the registration adjustment so that the registration deviation amount can be reduced to 1 dot pitch at the maximum. This is followed by measuring in terms of time the registration deviation amount of less than one dot to enable more efficient registration adjustment.

(Third Embodiment)

This embodiment further improves the precision of the registration deviation measurement performed by the first and second embodiments and, in particular, further reduces the effect the carriage speed variations have on the registration deviation measurement.

Figure 12:
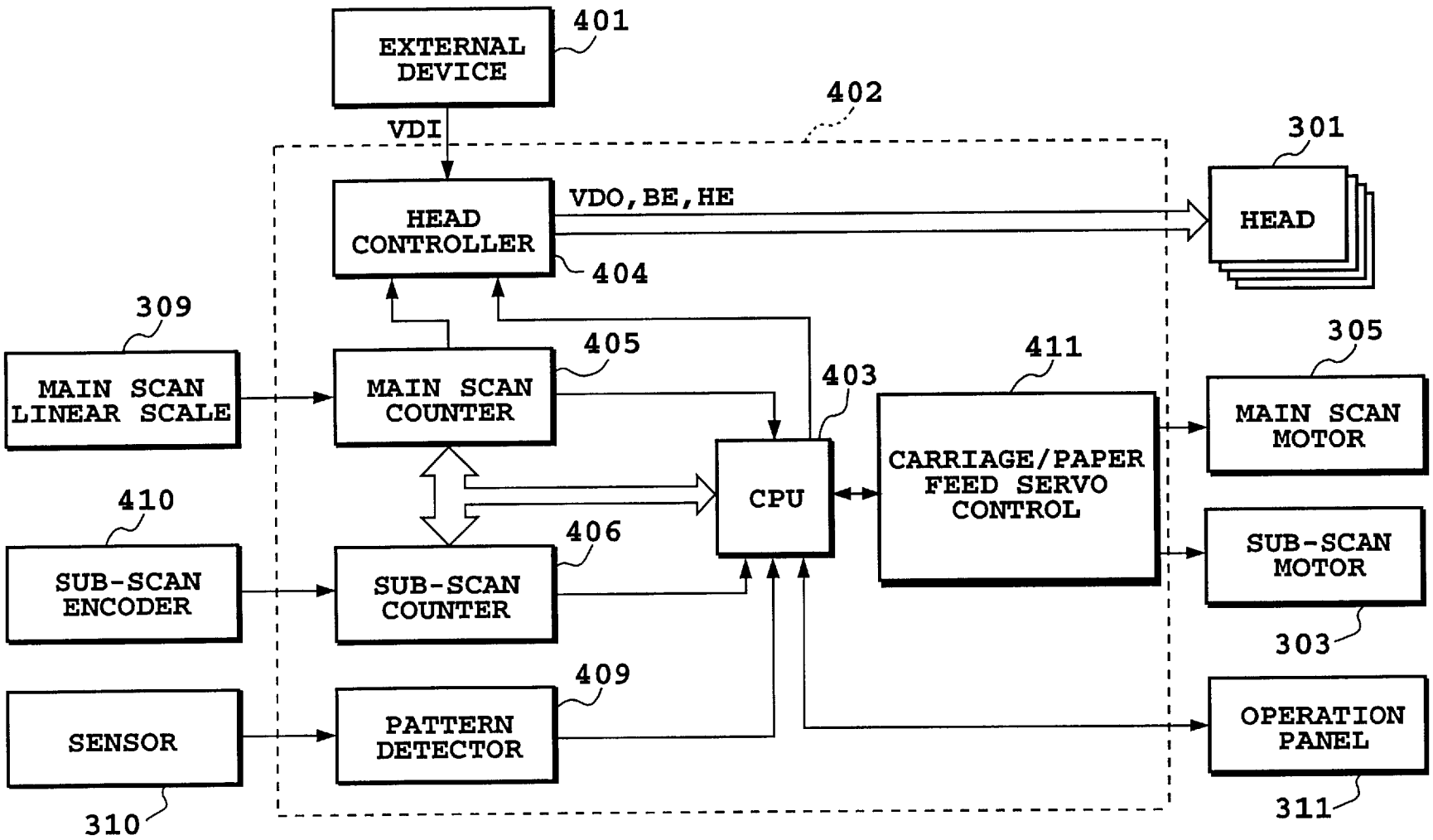
FIG. 12 is a block diagram showing mainly a control configuration of an ink jet printing apparatus according to a third embodiment of the invention.

FIG. 12 is a block diagram showing mainly the control configuration of the ink jet printing apparatus according to this embodiment.

Figure 1:
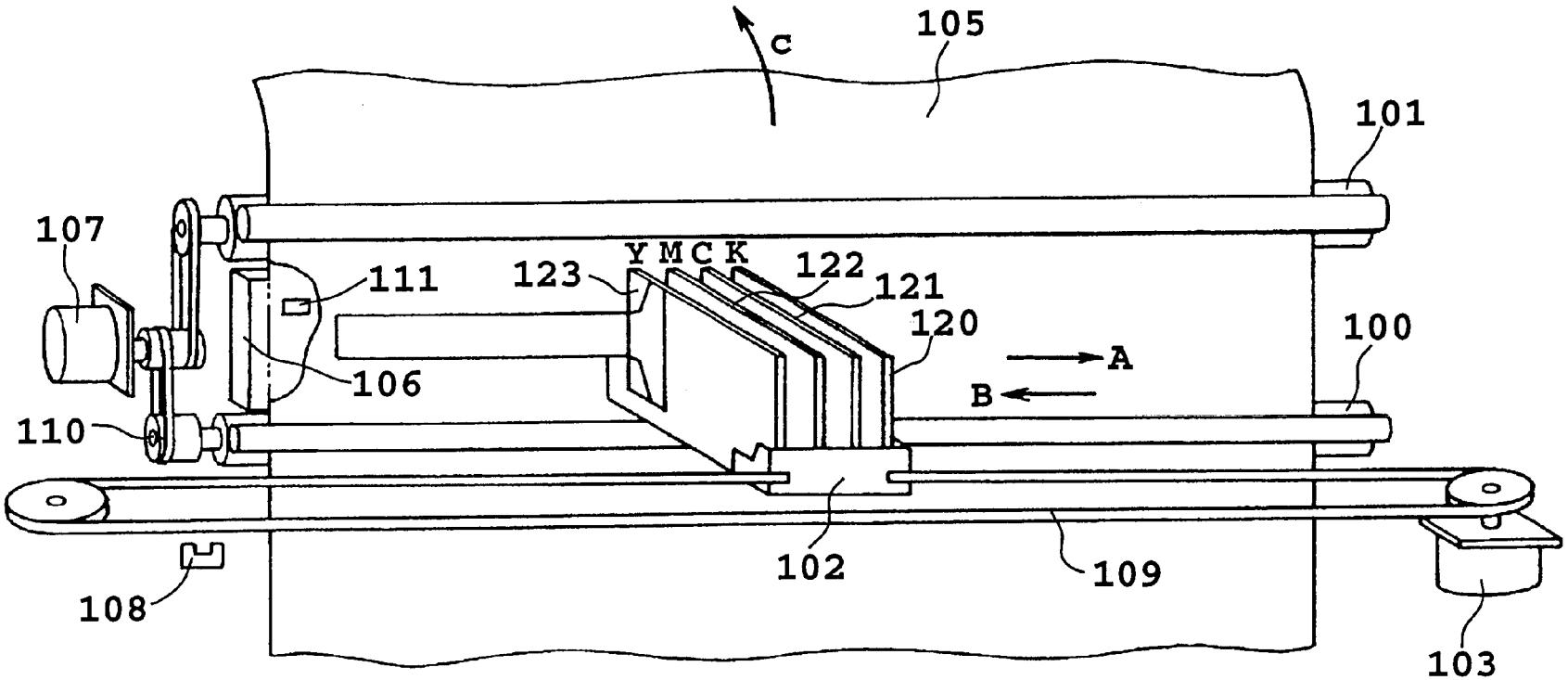
FIG. 1 is a perspective view showing one example of an ink jet printing apparatus.
Figure 2:
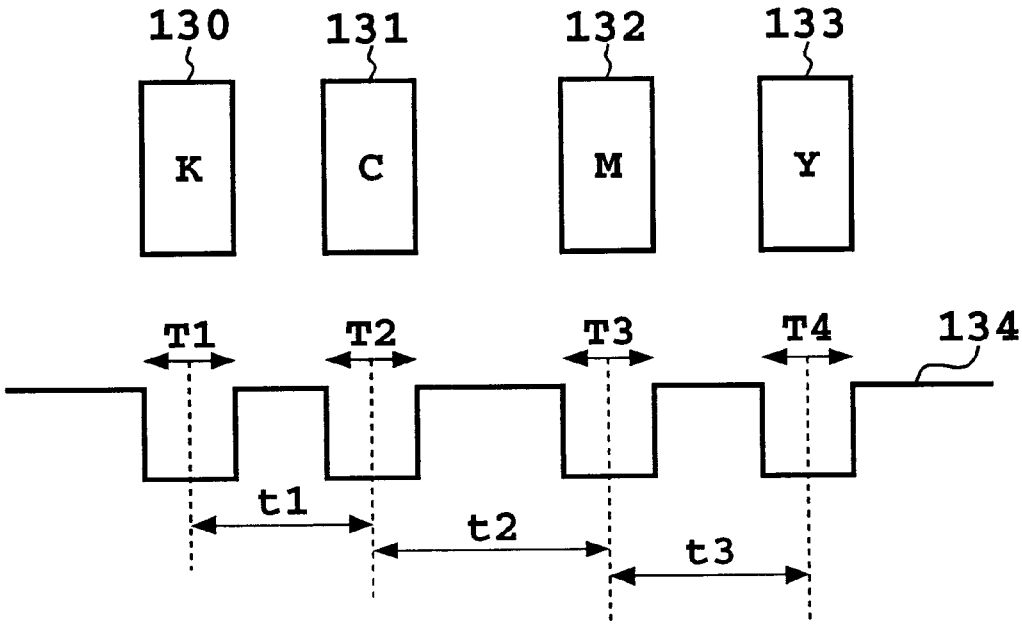
FIG. 2 is an illustration showing an example of a conventional technique for correcting registration among a plurality of print heads.

The ink jet printing apparatus of this embodiment has a print mechanism section similar to the one shown in FIG. 1 and also a print control section 402 shown in FIG. 12 to control various data processing and operation of various parts associated with printing. The print control section 402 is connected through drivers with a main scan linear scale 309, a sub-scan encoder 410, a main scan motor 305, a sub-scan motor 303, a sensor 110 and an operation panel 311. Based on image data transferred from an external device 401, the print control section 402 can control the above-described parts to perform printing. The external device may be in the form of a personal computer and an image reader, for example.

To described in more detail, the print control section 402 includes a CPU 403, a head controller 404, a main scan counter 405, a subscan counter 406, a pattern detector 409, and a carriage/paper feed servo controller 411. The CPU 403 performs interface processing with the external device 401 and controls the data processing and operations for the entire print control section 402 by using memories and I/O. That is, when serial image data VDI is transferred from the external device 401, the CPU 403 stores. several bands of the image data VDI in the image memory of the head controller 404. The stored image data VDI undergoes various image processing and image data VDO is output in synchronism with the scan action of the head 301.

Figure 14:
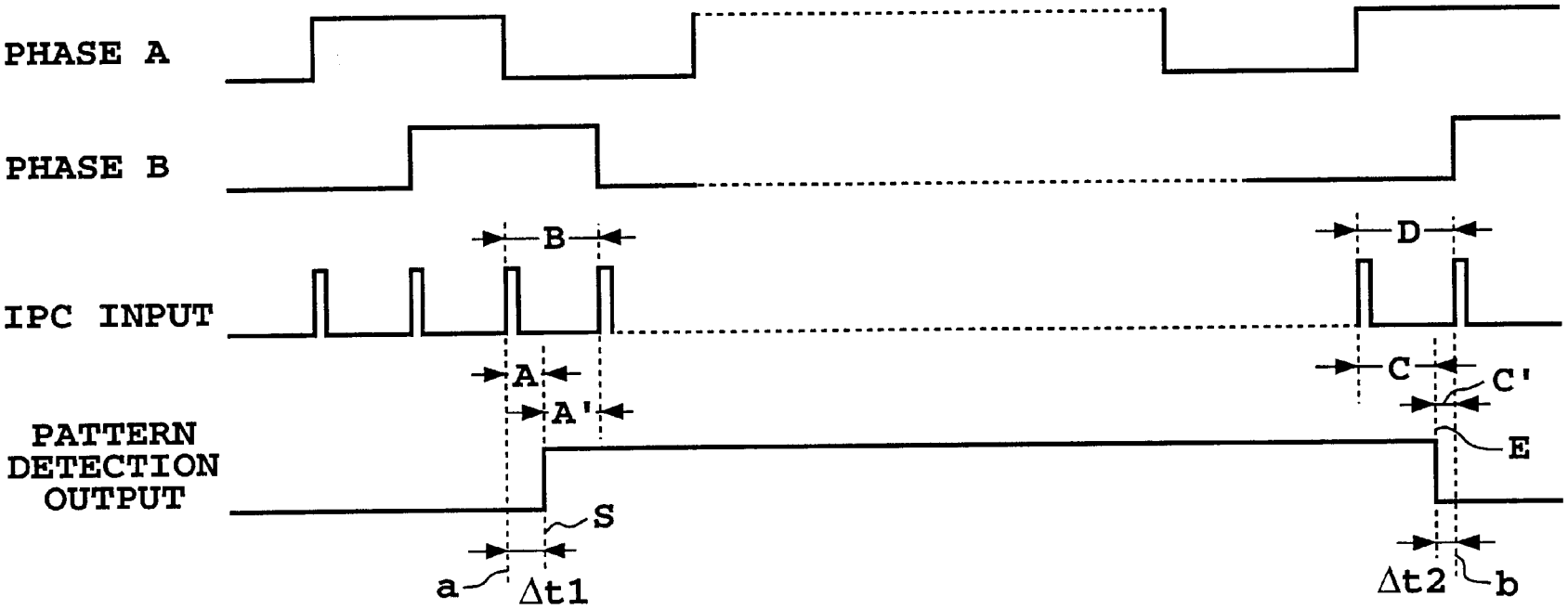
FIG. 14 is a timing chart of signals produced in the measurement processing.

The main scan linear scale 309 outputs two phase signals (phase A and phase B) as shown in FIG. 14 that represent an absolute position of the carriage in the apparatus corresponding to the distance traveled by the carriage as it is driven by the main scan motor 305. Similarly, the sub-scan encoder 410 outputs two phase signals that represent an absolute position of the paper corresponding to the distance by which the paper is fed by driving the sub-scan motor 303.

The main scan counter 405 counts the encoder signal from the main scan linear scale 309 and outputs the count value to the CPU 403. Similarly, the sub-scan counter 406 also counts the encoder signal from the sub-scan encoder 410 and outputs the count value to the CPU 403. The signals representing these count values are connected to input capture (IPC) terminals of the CPU 403. The IPC terminals are provided as an internal function of CPU and have their IPC terminal inputs related with the internal timer of CPU. Thereby, a period (timer value) of the input signals from the IPC terminals can be selected from among leading edge-to-trailing edge, trailing edge-to-leading edge, leading edge-to-leading edge and trailing edge-to-trailing edge periods. For CPUs with no such IPC terminal functions, signals from the main scan counter 405 and the sub-scan counter 406 are connected to interrupt terminals to generate interrupts at the leading and trailing edges of the input signals, and the interrupt processing triggered by these signals can obtain a desired period of the input signals from the timer value.

The head controller 404 generates various signals necessary for the driving of the print head, including image data VDO, a block enable signal BE associated with block driving in the print head 301 and a pulse waveform signal HE to be applied to a heater of each block. That is, when the image data VDO, the block enable signal BE, the pulse waveform signal HE and others are transferred at predetermined timings to the driver of the print head 301, a pulse voltage according to the pulse signal waveform is applied to a heater for which these signals are "on" to cause an ink droplet to be ejected from the corresponding ejection orifice (nozzle). Such an operation is performed for each print head as the carriage is moved, to perform printing for one band.

The carriage/paper feed servo controller 411, based on the signals from the main scan linear scale 309 and the sub-scan encoder 410, performs a feedback control on the speed, start, stop and the amount of movement of the main scan motor 305 and the sub-scan motor 303.

The operation panel 311 is used by a user to specify a variety of operations and processing of the printing apparatus of this embodiment, such as print mode, demonstration printing and ejection performance recovery operation of the print head. Further, the registration adjustment is also specified through the operation panel 311 during the replacement of the printing head of this embodiment and also in the event that the registration deviation is produced by the replacement.

Figure 13A:
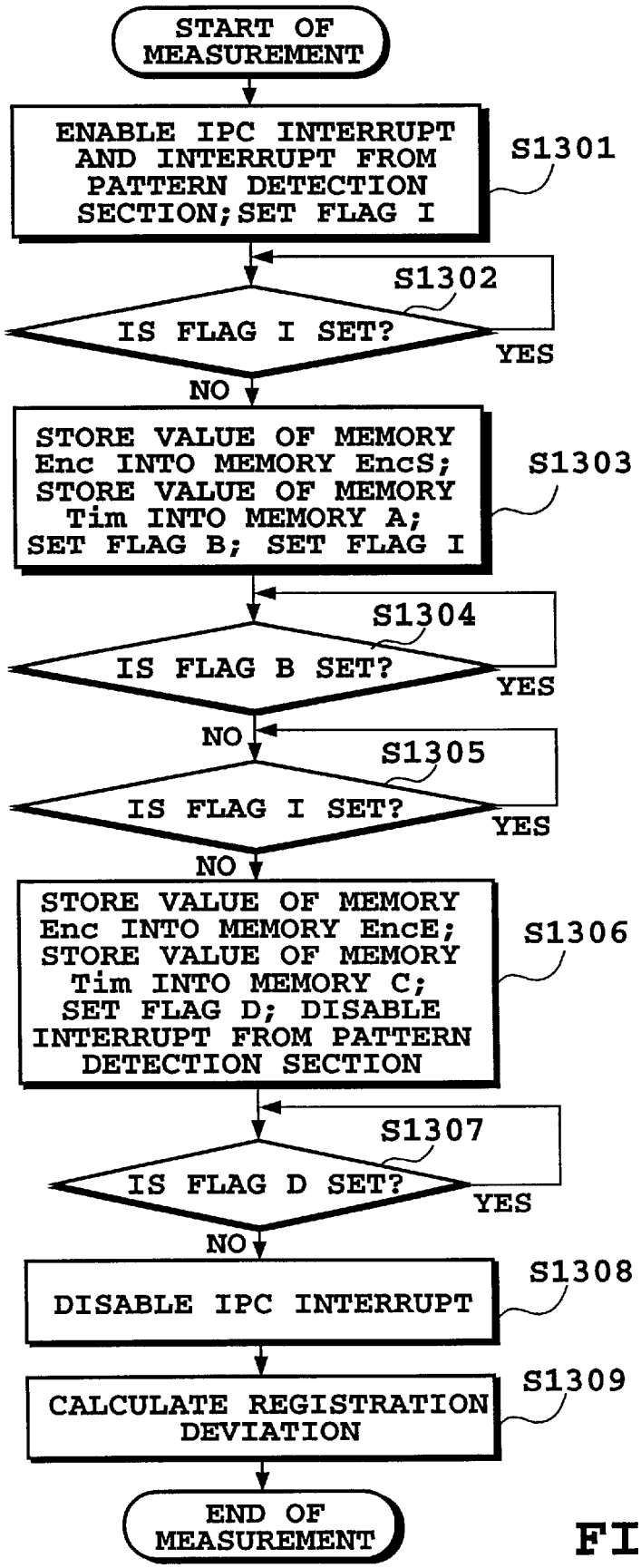
FIGS. 13A, 13B and 13C are flowcharts showing registration deviation measurement processing according to the third embodiment.
Figure 13B:
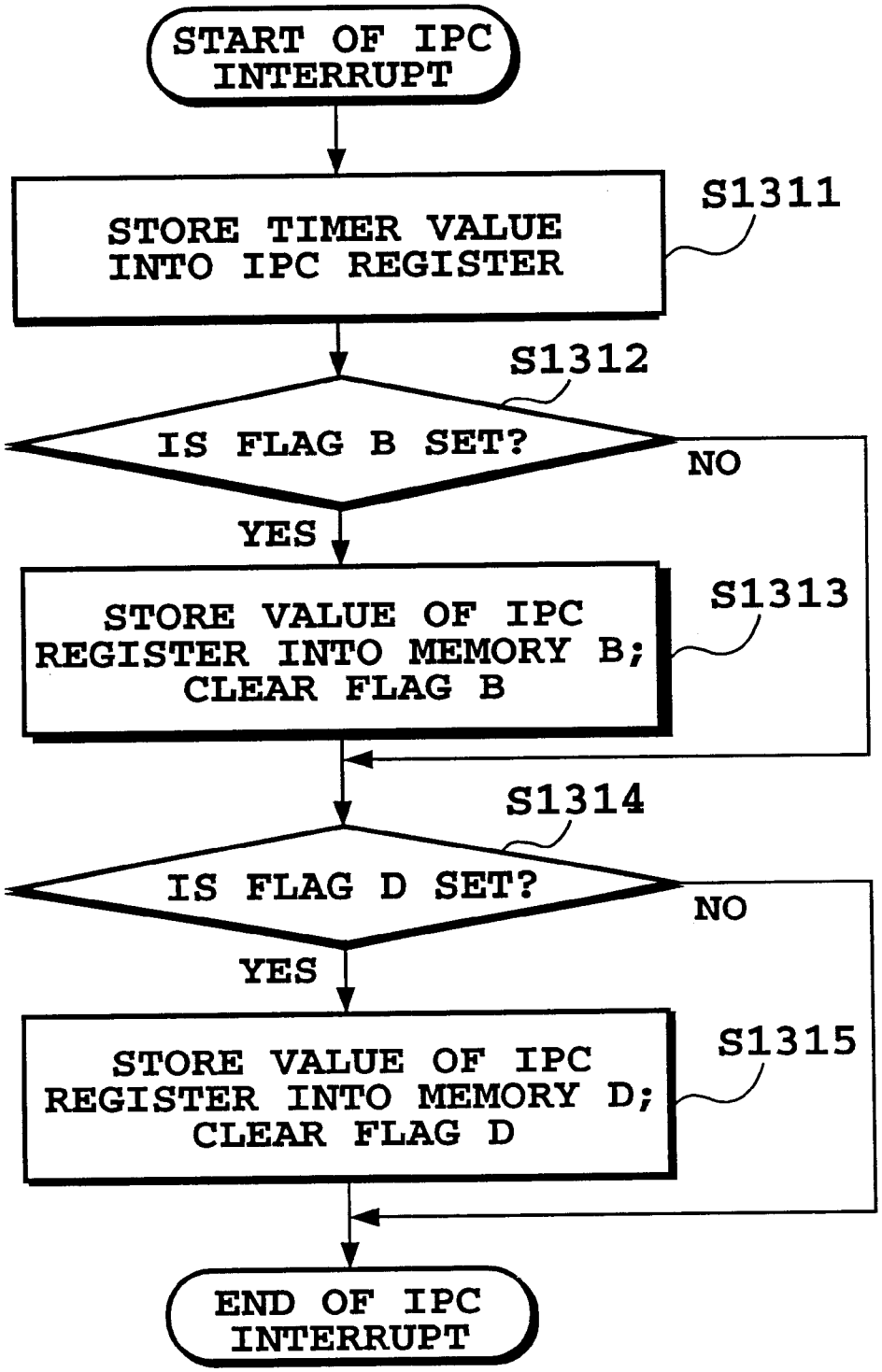
Figure 13C:
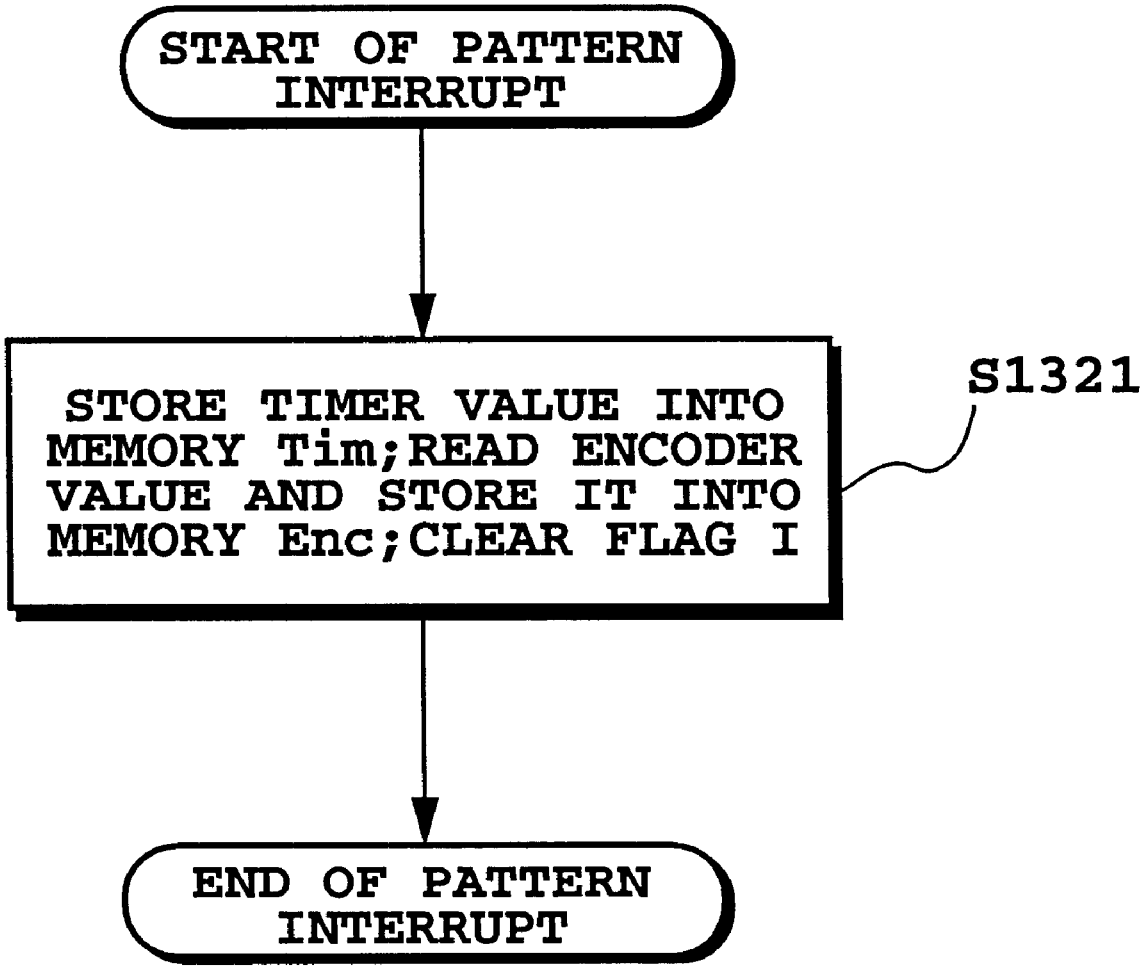

The positional deviation detection processing in the ink jet printing apparatus of this embodiment described above will be explained by referring to FIGS. 13A, 13B and 13C and FIG. 14. FIGS. 13A, 13B and 13C are flowcharts showing the procedures for the positional deviation detection processing of this embodiment. FIG. 14 is a timing chart showing signals occurring during the processing.

Figure 15A:
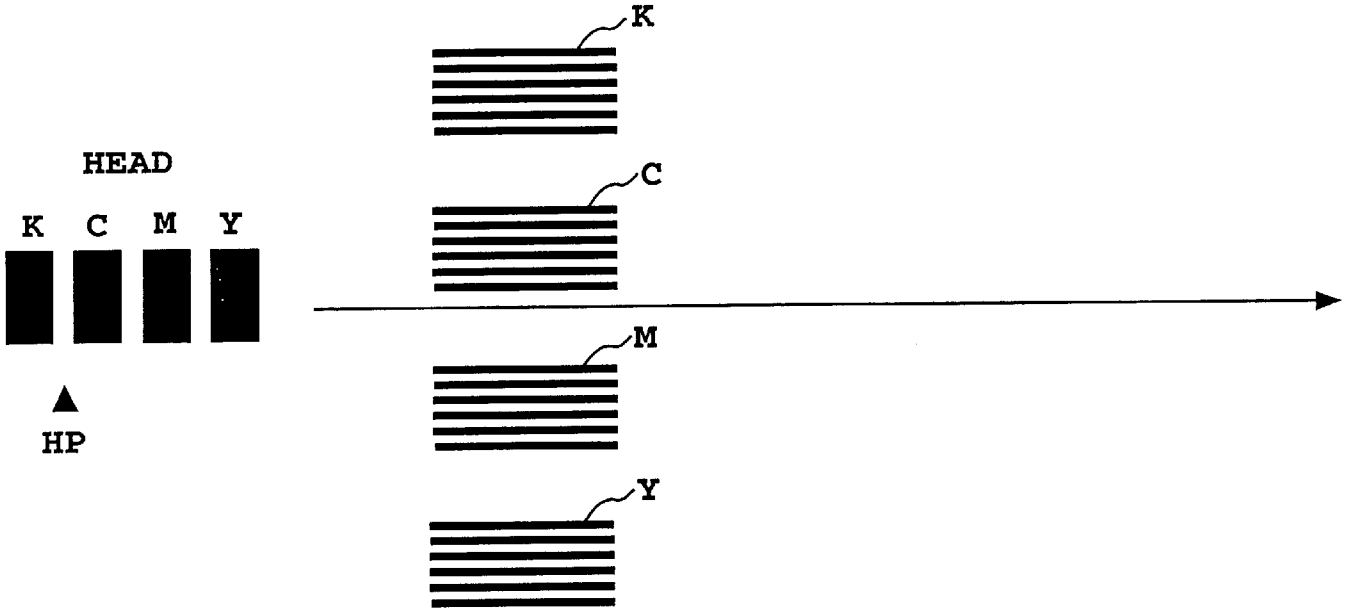
FIGS. 15A and 15B illustrate measurement patterns used in the measurement processing.
Figure 15B:
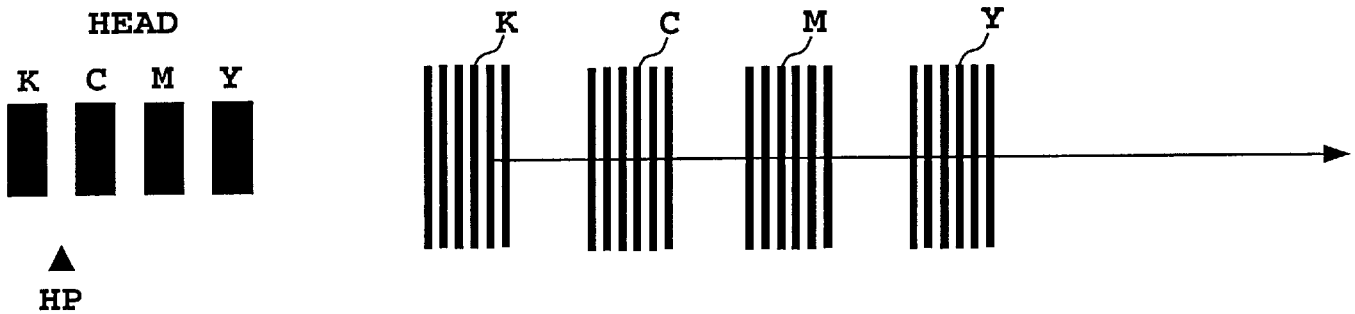

In the positional deviation detection processing, a procedure shown in FIG. 13A is started first. First of all, the measuring patterns for the positional deviation (herein after also referred as "registration deviation") detection are printed but this printing step is not shown in the figure. The measuring patterns are shown in FIGS. 15A and 15B. The horizontal bar patterns shown in FIG. 15A are used to measure the registration deviation in the paper feed direction, while the vertical patterns shown in FIG. 15B are used to measure the registration deviation in the main scan direction of the print head.

The following description concerns the registration deviation measuring processing in the main scan direction. When the measuring patterns are printed the measuring processing is started. At step S1301, an IPC interrupt at the leading edge of the signal from the main scan counter 405 and a pattern interrupt at the leading and trailing edges of the signal from the pattern detector 409 are enabled. At the same time, a flag I is set. Then, the processing waits for the flag I to be cleared.

This flag I is produced at the leading edge (point S in FIG. 14) of the pattern detection signal associated with the pattern interrupt processing enabled at step S1301 and is cleared by the pattern interrupt processing that was enabled (step S1321 in FIG. 13C). Also at this step S1321, the encoder value at when the pattern interrupt occurs, i.e., the count value counted by the main scan counter 405, is stored in a memory Enc and a timer value is stored in a memory Tim.

When it is decided that the flag I is cleared and the pattern interrupt processing is completed (step S1302), step S1303 stores a value of the memory Enc and a value of the memory Tim into a memory EncS and a memory A, respectively. Step s1303 also sets a flag B and a flag I. By the processing at step s1303, the encoder value at time S in FIG. 14 has been stored into the memory EncS and the time corresponding to the time A into the memory A. Then, the next step S1304 waits for the flag B to be cleared.

The flag B is cleared by an IPC interrupt processing initiated every leading edge of the IPC signal shown in FIG. 14. That is, step S1304 waits for the processing of step S1313 in the IPC interrupt (FIG. 13B), which was enabled by step S1301, to be executed and also for the timer value corresponding to the time B shown in FIG. 14 to be stored into a memory B. When step S1304 has decided that the flag B is cleared indicating that the timer value has been stored, it waits for the flag I to be cleared (step S1305).

When the flag I is cleared, that is, when the pattern interrupt (FIG. 13C) is executed, as in step S1302, the value of the memory Enc is stored into a memory EncE and the value of the memory Tim is stored into a memory C, with respect to a point of time E at the end of the pattern detection signal shown in FIG. 14 (step S1306). Then, next step 1307 waits for a flag D to be cleared.

That is, step s1307 waits that for step S1315 in the IPC interrupt (FIG. 13B) to be executed to store the timer value corresponding to a time D shown in FIG. 14 into a memory D.

When the flag D is cleared, step S1308 disables the IPC interrupt and the next step S1309 calculates the registration deviation amount according to the memory values thus obtained and terminates the main processing. The above-described IPC interrupt processing shown in FIG. 13B will be explained in more detail. This processing is initiated at the leading edge of the IPC input signal and at first stores the timer value present at this leading edge into the IPC register (step S1311). This step S1311 is performed by hardware, and the timer value after being stored is cleared. That is, what is actually performed as the interrupt processing is the one following the step S1312.

When an IPC interrupt occurs, it is checked whether the flag B is set or not (step S1312). When the flag is set, step S1313 stores into the memory B the IPC register value, i.e., the timer value present when the IPC interrupt occurred, and at the same time clears the flag B. Next, a check is made to see whether a flag D is set or not (step S1314). When the flag D is found set, the value of the IPC register, in this case a time D at the end of the pattern detection signal, is stored into a memory D and the flag D is cleared (step S1315).

As a result of the processing shown in FIGS. 13A, 13B, 13C, the encoder value at the point in time S shown in FIG.

14 is stored into Encs and the value corresponding to times A, B into the memories A, B. Similarly, the encoder value at the point in time E and the values corresponding to times C, D are stored into EncE and memories C, D, respectively.

Then, step S1309 of FIG. 13A determines the registration deviation amounts as follows according to the values thus stored.

First, the values shown in FIG. 14 are determined:

$$A'=B-A$$

$$C'=D-C$$

Then the encoder value and the time value are determined as measured values in the following cases.

When A'>A; the encoder value=EncS and the time value=A.

When A'<A; the encoder value=EncS+1 and the time value=−A'.

When C'>C; the encoder value=EncE and the time value=C.

When C'<C; the encoder value=EncE+1 and the time value=−C'.

More specifically, in this embodiment, with respect to the front and rear end of the registration deviation measuring pattern printed by each print head, the time values of A and A' and C and C' are respectively determined based on the IPC input as a reference, which is an output from the main scan linear scale not to be affected by the speed variation of the carriage. Then, the respective smaller time values between A and A' and between C and C' are used as time values representing the registration deviation. This further improves the precision of the registration deviation measurement over those obtained by the first and second embodiment. In more detail, one of the respective smaller values, that is, the smaller value A or A' and the smaller value C or C', with respect to the front and rear ends is used for each color pattern. Then, the registration deviations of the respective heads are determined based on the smaller value as in the first and second embodiments. In alternative, a mean value of the smaller value A or A' and the smaller value C or C' with respect to the front and rear ends may be used as the registration deviation value.

The registration deviation amount calculation processing (step S1309) according to this embodiment is performed in this manner and, in the subsequent processing, the correction is made in a way similar to that explained in the preceding embodiments.

One example of the above-mentioned values in the printing apparatus of this embodiment is presented here. As for the registration deviation measurement in the main scan direction, if the resolution of the encoder (linear scale) is 600 dpi, the main scan linear scale 309 outputs A- and B-phase signals 90 degrees out of phase with each other every 42.33 μsec of the carriage movement. In this case, as shown in FIG. 14, counting is done at the leading and trailing edges of each of the A- and B-phase signals and thus the position detection can be made with the precision of 2400 dpi (10.583 μm).

Now, if the carriage moving speed during the scanning of the measuring pattern is 100 mm/sec and the time measurement resolution of the timer is 1 μsec and if there is no variation in the carriage speed, the carriage moves 0.1 μm each time the timer counts 1 μsec. That is, if there is no speed variation of the carriage, the one count of the encoder is converted into the time of 105.83 μsec and thus the timer count is 105 or 106.

As described above, the relation between the encoder count value and the timer measurement value in connection with the registration deviation measurement is determined by the carriage speed during the pattern measurement operation and the resolutions of the encoder and timer.

Considering these, this embodiment adopts whichever of the pattern detection signal time values measured based on the encoder input as a reference is smaller, as described above, in order to minimize the effect the carriage speed variation has on the registration deviation measurement.

While the above embodiment mainly concerns the registration deviation in the main scan direction, it should also be noted that the calculation of the registration deviation amount in the paper feed direction (sub-scan direction) can also be performed in the similar manner.

Although the above embodiment has described the configuration using the IPC function of CPU, the same configuration may be constructed with hardware and the information may be read out by the CPU. In this case, the CPU can use the output of the main scan counter 405 or sub-scan counter 406 as a trigger.

The present invention achieves distinct effect when applied to a printing head or a printing apparatus which has means for generating thermal energy such as electro-thermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electro-thermal transducers, each disposed on a sheet or liquid passage that retains liquid (ink), and operates as follows: first, one or more drive signals are applied to the electro-thermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electro-thermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electro-thermal transducers is used as ejection orifices of the electro-thermal transducers, and the latter discloses a structure in which openings for absorbing pressure waves caused by thermal energy are formed corresponding to the ejection orifices. Thus, irrespective of the type of the printing head, the present invention can achieve printing positively and effectively.

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electro-thermal transducers or a combination of other heater elements and the electro-thermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electro-thermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

According to above-stated embodiments, based on a result of reading the registration adjustment patterns, time differences are calculated between print start timing obtained from these patterns and the leading or trailing edge timing of the output signal for each head, which is detected in connection with the print start timing, from the print position detection means, such as an encoder, that outputs a signal representing stationary coordinates with respect to the apparatus. A difference between these time differences, which are determined for individual print heads, is taken as the print timing deviation of the print heads with respect to each other and then corrected. Thereby, the time difference is smaller than a pitch of the print positions corresponding to periods or cycles of the output signal from the print position detection means and therefore it is possible to perform finer corrections. As a result of this, a high precision adjustment for registration can be performed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing printing on a printing medium by using a plurality of print heads, comprising:

scanning means for causing a plurality of print heads to scan over the printing medium relatively to each other;

print position detection means for detecting a print position of each print head with respect to the printing medium during scanning by the scanning means and for outputting a position detection signal representing the print position thus detected;

pattern printing means for causing the plurality of print heads to print respective registration adjustment patterns during scanning by the scanning means;

pattern detection means for reading the registration adjustment patterns during scanning in the relative scanning direction to output signals representing the print positions of the plurality of the print heads; and registration adjustment means for determining, for each of the plurality of the print heads, a time difference between a first predetermined timing in pattern printing obtained from the signal output by the pattern detection means and a second predetermined timing obtained, in connection with the first predetermined timing, from the position detection signal output by the print position detection means, the time difference being smaller than a period of the position detection signal, and for correcting respective print timings of the plurality of the print heads according to the time difference between the plurality of the print heads.

2. A printing apparatus as claimed in claim 1, wherein the second predetermined timing of the position detection signal output by the print position detection means and the first predetermined timing of the signal output by the pattern detection means are a leading edge or a trailing edge of the associated signals.

3. A printing apparatus as claimed in claim 1, wherein, from respective two time differences between two successive respective second predetermined timings in the position detection signal and the first predetermined timing of the pattern printing, a smaller time difference is selected to be determined as said time difference.

4. A printing apparatus as claimed in claim 1, further comprising means for determining positional deviation amounts between the plurality of the print heads according to information on print positions determined from the position detection signal output by said print position detection means.

5. A printing apparatus as claimed in claim 4, wherein the plurality of the print heads include a print head printing with black color, said print position detection means outputs the position detection signal related to said black print head as a reference, and said registration adjustment means determines a difference of the time differences between said black ink print head and other print heads.

6. A printing apparatus as claimed in claim 5, further comprising non-volatile memory means for storing a difference of the time differences between the plurality of the print heads;

wherein the difference of the time differences is determined at time when the print head is replaced or at a predetermined timing and stored in said non-volatile memory means; and when power for said apparatus is turned on, the print timing is corrected according to the difference of the time differences between the print heads stored in said non-volatile memory means.

7. A printing apparatus as claimed in claim 6, wherein the positional deviation amounts of the plurality of the print heads with respect to each other determined by said positional deviation amount determining means are corrected by correcting addresses at which print data is read from the memory to correct the print position.

8. A printing apparatus as claimed in claim 7, wherein the plurality of the print heads each eject ink to perform printing.

9. A printing apparatus as claimed in claim 8, wherein the plurality of the print heads each utilize thermal-energy to generate a bubble in ink to eject ink by pressure of the bubble.

10. A printing apparatus as claimed in claim 3, wherein said two time difference are determined with respect to two points in the registration adjustment pattern and a mean value of the respective smaller time difference with respect to said two points is determined as said time difference.

11. A registration deviation detection method in a printing apparatus using a plurality of print heads to perform printing on a printing medium, comprising the steps of:

preparing print position detection means for detecting a print position of each print head with respect to the printing medium during scanning of the print heads and for outputting a position detection signal representing the print position thus detected, and pattern detection means for reading registration adjustment patterns during scanning in a relative scanning direction to output signals representing the print positions of the plurality of the print heads;

printing the registration adjustment patterns by using the plurality of the print heads while the plurality of the print heads are scanned; and determining, for each of the plurality of the print heads, a time difference between a first predetermined timing in pattern printing obtained from the signal output by the pattern detection means and a second predetermined timing obtained, in connection with the first predetermined timing, from the position detection signal output by the print position detection means, the time difference being smaller than a period of the position detection signal, and for correcting respective print timings of the plurality of the print heads according to the time difference between the plurality of the print heads.

12. A registration deviation detection method as claimed in claim 11, wherein, from respective two time differences between two successive respective second predetermined timings in the position detection signal and the first predetermined timing of the pattern printing, a smaller time difference is selected to be determined as said time difference.

* * * * *

UNITED STATES PATENT AND TRADEMARK OFFICE

CERTIFICATE OF CORRECTION

PATENT NO. : 6,390,588 B1
DATED : May 21, 2002
INVENTOR(S) : Keiichi Ikeda

It is certified that error appears in the above-identified patent and that said Letters Patent is hereby corrected as shown below:

Column 1,
Line 61, “at” should read -- at the --.

Column 5,
Line 7, “a” should read -- an --;
and “not shown” should read -- (not shown) --.

Column 6,
Line 15, “initiated.” should read -- is initiated. --;
Line 61, “detection.” should read -- detection --; and
Line 66, “Rsec” should read -- $\mu$sec --.

Column 9,
Line 18, “these processing differ” should read -- this processing differs --; and
Line 34, “not shown” should read -- (not shown) --.

Column 10,
Line 50, “To described” should read -- To describe, --; and
Line 58, “stores.” should read -- stores --.

Column 12,
Line 12, “at” should be deleted.
Lines 20 and 21, “s1303” should read -- S1303 --;
Line 39, “step 1307” should read -- step S1307 --; and
Line 41, “s1307” should read -- S1307 --.

Column 13,
Line 33, “embodiment” should read -- embodiments --.

Column 14,
Line 27, “is” should read -- are --.

Column 15,
Line 6, “consists” should read -- consist --.

UNITED STATES PATENT AND TRADEMARK OFFICE

CERTIFICATE OF CORRECTION

PATENT NO. : 6,390,588 B1 
DATED : May 21, 2002
INVENTOR(S) : Keiichi Ikeda

It is certified that error appears in the above-identified patent and that said Letters Patent is hereby corrected as shown below:

Column 18,
Line 2, "difference" should read -- differences --.

Signed and Sealed this

Fourteenth Day of January, 2003

JAMES E. ROGAN
*Director of the United States Patent and Trademark Office*